United States Patent [19]

Mercier

[11] 3,989,185

[45] Nov. 2, 1976

[54] CENTRIFUGAL MACHINE

[75] Inventor: Andre Mercier, La Madeleine, France

[73] Assignee: Fives-Cail Babcock, Paris, France

[22] Filed: June 23, 1975

[21] Appl. No.: 589,349

[30] Foreign Application Priority Data

June 17, 1974 France ..... 74.20914

[52] U.S. Cl. ..... 233/27; 233/2; 233/34; 233/45

[51] Int. Cl.[2] ..... B04B 7/00; B04B 11/06

[58] Field of Search ..... 233/2, 16, 27, 28, 31, 233/32, 34, 35, 46, 45

[56] References Cited

UNITED STATES PATENTS

| | | | |
|---|---|---|---|
| 2,753,010 | 7/1956 | Walther | 233/27 X |
| 3,205,095 | 8/1965 | Dietzel et al. | 233/2 X |
| 3,630,432 | 12/1971 | Murkes | 233/45 |
| 3,682,373 | 8/1972 | Mercier | 233/2 X |
| 3,837,913 | 9/1974 | Hillebrand et al. | 233/34 X |

*Primary Examiner*—George H. Krizmanleh
*Attorney, Agent, or Firm*—Kurt Kelman

[57] ABSTRACT

A slurry-feeding arrangement for a continuously operating, vertical, centrifugal filter includes a dish-shaped receptacle coaxially mounted on the hub portion of the bowl and a distributor having the shape of an inverted cup enveloping the receptacle and connected to the hub by radial arms of a spider plate integral with the receptacle. The slurry to be filtered is centrifugally deposited from the receptacle on the inner face of the distributor, and thinning of the deposited film of slurry on the segments of the distributor face between the arms and the open end of the distributor is prevented by radially open recesses on either circumferential side of each arm in the inner distributor face.

9 Claims, 3 Drawing Figures

CENTRIFUGAL MACHINE

This invention relates to centrifugal machines, and particularly to centrifugal apparatus having an improved feeding device for separating a viscous slurry into solid and liquid fractions.

The invention will be described hereinbelow with reference to the separation of raw sugar crystals from molasses, and to a wide-angle centrifugal filter equipped with a base-bearing, solid-bottom bowl, but is not limited to the specific centrifugal machine described and illustrated.

It is known to feed a concentrated sugar slurry to the bowl of a centrifugal filter while the bowl rotates continuously about its vertical axis. The slurry is discharged into a receptacle coaxially mounted on the hub portion of the bowl, and discharged from the circular rim of the receptacle to the inner annular face of a distributor from which it is discharged on the lower, small end of a filtering surface on the bowl. The distributor is fastened to the bowl by means of a spider whose radial arms divide the approximately uniform film of slurry as it descends over the inner distributor face. Because of the great viscosity of the slurry, it does not regain its initial, practically uniform distribution about the axis of rotation, and a thinner streak of slurry extends below each of the spider arms. The resulting, circumferentially non-uniform supply of slurry to the bowl significantly impairs the performance of the filter.

It is a primary object of this invention to provide a centrifugal machine of the type described in which the unfavorable effects of the spider arms can be avoided.

With this object and others in view, the centrifugal machine of the invention has a bowl and a drive arrangement which includes a hub portion of the bowl. A receptacle is mounted in the bowl for rotation about the bowl axis, and an axially terminal portion of the receptacle is open in one axial direction. The annular inner face of a distributor spacedly envelops the terminal receptacle portion and flares in the other axial direction. Radial arms interposed between the hub portion and the inner distributor face secure the distributor to the bowl for joint rotation. Two recesses contiguously adjacent each arm in respective circumferential directions are axially open and radially open toward the axial passages defined between the arms, the arms and recesses being located in a common radial plane. The slurry to be processed is fed to the receptacle.

Other features, additional objects, and many of the attendant advantages of this invention will readily be appreciated as the same becomes better understood by reference to the following detailed description of a preferred embodiment when considered in connection with the appended drawing in which.

Figure 1:
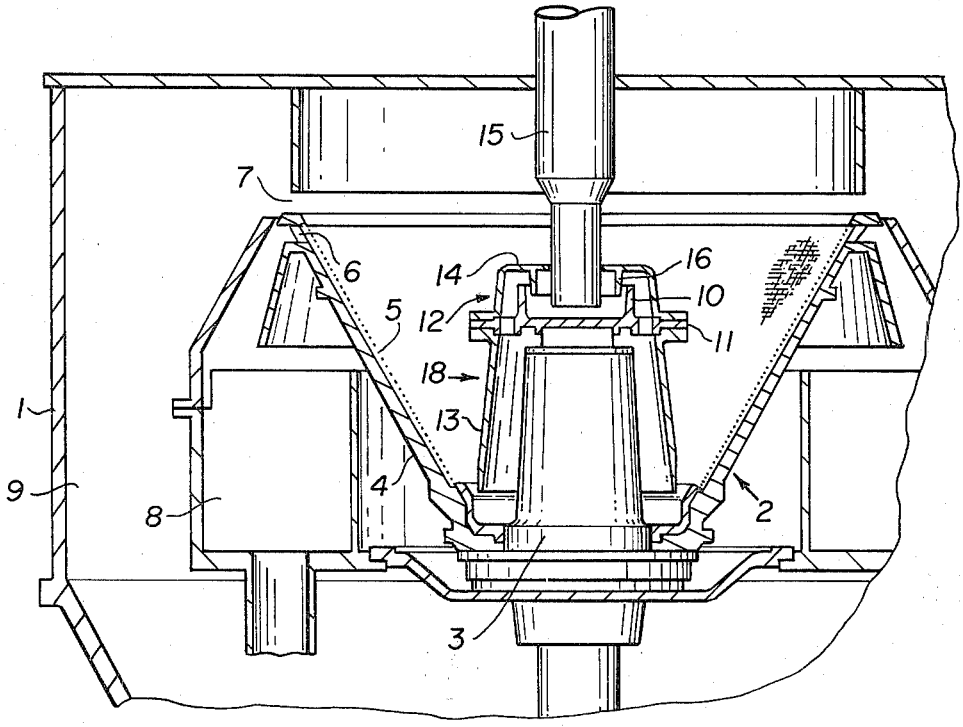
FIG. 1 shows a centrifugal filter of the invention in fragmentary elevational section.

Referring now to the drawing in detail, and initially to FIG. 1, there is seen the housing 1 of a centrifugal filter, whose bowl 2 is rotated about a normally vertical axis by a conventional drive arrangement of which the hub portion 3 of the bowl 2 is the terminal element. The imperforate, axial wall 4 of the bowl 2 is fixedly fastened to the hub portion 3, flares conically in an upward direction, and is lined with a wire screen 5. Separate overflows 6, 7 near the upper rim of the bowl lead from the annular space between the screen 5 and bowl 4 into a trough 8, and from the upper end of the screen 5 into a trough 9 for separately collecting the liquid and solid fractions of a slurry fed to the inner face of the screen 5, as is conventional.

This invention is more specifically concerned with the feeding arrangement for depositing the slurry to be filtered on the screen 5. The free top face of the hub portion 3 carries a coaxial, dish-shaped receptacle 10 whose axially terminal top portion is open in an axially upward direction, and from whose bottom an apertured radial flange 11 projects. The flange 11 is clamped axially between an element 12 having the shape of an inverted, conically flaring cup, and an element 13, hereinafter referred to as the rim element, which flares conically in a downward direction toward its free rim, the elements 12, 13 having inner axial faces of circular cross section about the axis of bowl rotation. The radial wall 14 of the cup-shaped element 12 has a central aperture through which a feed pipe 15, fixedly mounted on the housing 1, extends toward the receptacle 10. An inner, annular, axial wall 16 of the element 12 extends downward from the radial wall 14 to bound a feed channel and to contain material splashing from the surface of the slurry in the receptacle 10.

Figure 2:
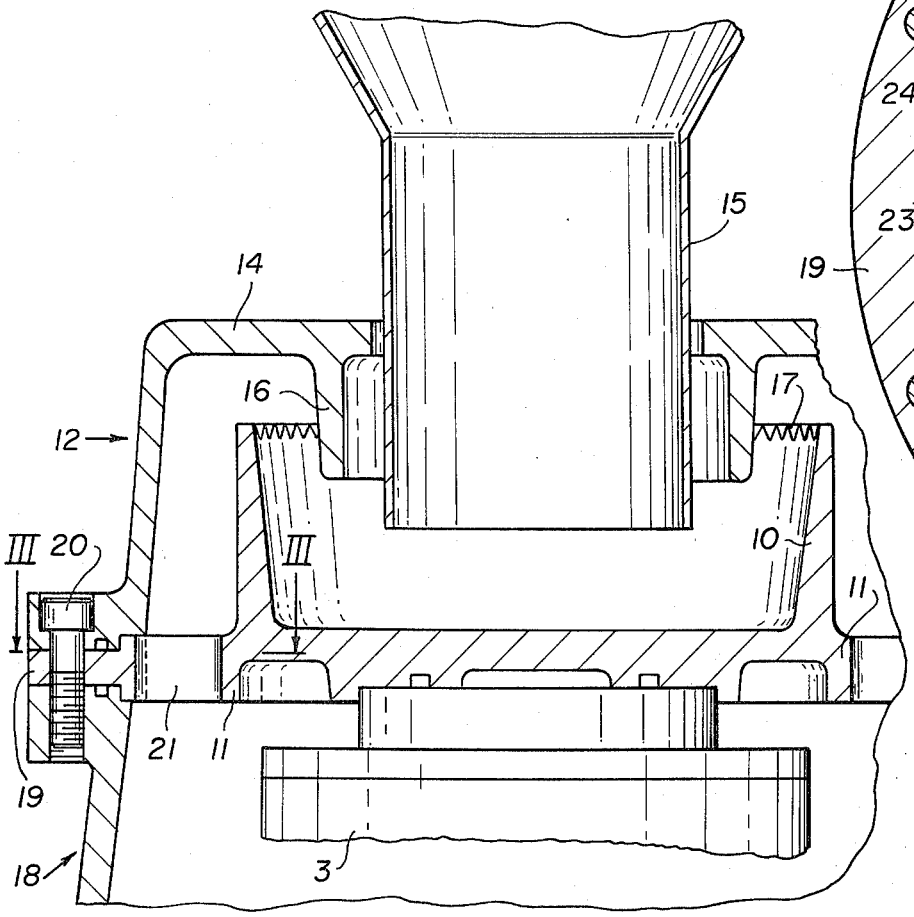
FIG. 2 illustrates a portion of the apparatus of FIG. 1 on a larger scale.
Figure 3:
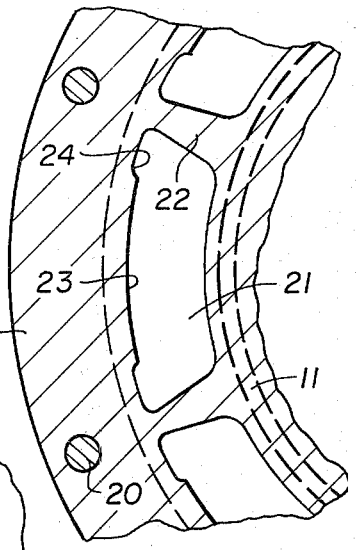
FIG. 3 is a fragmentary section of the device of FIG. 2 taken on the line III — III.

As is better seen in FIGS. 2 and 3, the top edge 17 of the receptacle 10 is serrated and offset axially upward from the lower edges of the wall 14 and of the feed pipe 15. Slurry entering the receptacle from the pipe 15 is centrifugally distributed from the edge 17 to the inner face of the distributor 18 constituted by the elements 12, 13 and by the peripheral portion 19 of the flange 11, the flange being fastened between the elements 12, 13 by screws 20.

Circumferentially elongated identical openings 21 along the peripheral portion 19 are separated from each other by radial arm portions 22 of the flange 11. The openings 21 provide axial passages through the flange 11 adjacent the flaring inner face of the distributor 18. Each opening 21 is bounded in a radially outward direction by a circumferentially central, cylindrically concave face portion 23 of the flange 11 and by two recesses 24 contiguously adjacent the arms 22. The recesses are radially open toward the opening 21 and their wall surfaces are parallel to the axis of bowl rotation.

As is best seen in FIG. 2, the face portions 23 are flush with the conical inner face of the distributor element 12 and project radially inward beyond the conical inner face of the rim element 13, whereas the wall surfaces bounding the recesses 24 are at least partly flush with the rim element 13. The conical surface defined by the element 12 spacedly envelops the corresponding surface defined by the element 13. Because of this configuration, the cross section of the inner distributor face increases downward in the zone axially subjacent the arms 22 in a sudden manner and at a greater rate than in the two axially offset, adjacent zones of the distributor 18.

During operation of the illustrated centrifugal filter, slurry is deposited in a film of fairly uniform thickness from the top edge 17 of the receptacle 10 on the inner axial face of the cup-shaped distributor element 12, and the film moves downward under the combined effect of gravity and centrifugal forces. Any initial non-uniformity is reduced by surface tension effects. As the film reaches the common radial plane of the arms 22 and of the passages 21, the circumferential portions of the film axially aligned with the cylindrical face portions 23 continue their downward movement although they are temporarily relieved of effective centrifugal forces. The film portions initially aligned with the arms 22 are deflected into the recesses 24 which are deep enough to accomodate the additional amount of slurry so that the slurry has an approximately uniformly cylindrical, exposed face in each opening 21 from one arm 22 to the other.

Below the common plane of the arms 22 and the passages 21, the suddenly increased cross section of the inner distributor face produces the surface tension and centrifugal forces which draw portions of the heavier slurry streams axially discharged from the recesses 24 into the face portions below the arms 22. The slurry film is of perfectly uniform thickness when it reaches the free lower rim of the distributor 18, and is discharged therefrom toward the narrow, lower end of the screen 5. Most of the liquid in the slurry passes through the screen, rises between the screen and the imperforate bowl wall 4 to the overflow 6, and is discharged into the trough 8, while the almost dry sugar crystals travel upward along the inner screen face to be discharged into the trough 9 from the overflow 7.

The dimensions of the recesses 24 need to be selected for the properties of the slurry to be separated, and the dimensional relationships shown particularly in FIG. 3 are illustrative of preferred practice in sugar manufacturing. Obviously, centrifugal apparatus intended for other purpose may benefit from the feeding arrangement of the invention, and the illustrated arrangement will readily be modified to suit the intended application.

It should be understood, therefore, that the foregoing disclosure relates only to a preferred embodiment of the invention, and that it is intended to cover all changes and modifications in the example of the invention herein chosen for the purpose of the disclosure which do not constitute departures from the spirit and scope of the invention defined in the appended claims.

What is claimed is:

1. A centrifugal machine comprising:

a. a bowl having a hub portion;

b. drive means for rotating said bowl continuously about an axis of rotation;

c. a receptacle mounted in said bowl for rotation therewith about said axis and having an axially terminal portion open in one axial direction;

d. a distributor having an inner face spacedly enveloping said terminal portion and flaring in an axial direction opposite to said one direction;

e. a plurality of radial arms interposed between said hub portion and said inner face and securing said distributor to said bowl for joint rotation,

1. said arms defining axial passages therebetween,

2. said inner face being formed with two recesses radially open toward said passages and axially open contiguously adjacent each arm in respective circumferential directions,

3. said arms and said recesses being located in a common radial plane; and f. feeding means for feeding a slurry to said receptacle.

2. A machine as set forth in claim 1, wherein said distributor in each of said recesses has a wall surface parallel to said axis.

3. A machine as set forth in claim 1, wherein the cross section of said inner face increases in said opposite direction in a zone axially adjacent said arms at a greater rate than in respective zones of said face axially offset from said zone in said one direction and in said opposite direction.

4. A machine as set forth in claim 1, wherein said arms are respective parts of a unitary plate member fixedly fastened to said hub portion, said plate member having a peripheral portion formed with said passages and with said recesses, said peripheral portion constituting a part of said distributor, the distributor further including a cup-shaped portion and an a rim portion axially offset from said plate member, said cup-shaped portion and said rim portion fixedly receiving said peripheral portion therebetween.

5. A machine as set forth in claim 4, wherein said peripheral portion has a plurality of faces parallel to said axis of rotation, each of said faces extending circumferentially between two of said recesses and bounding one of said passages in a radially outward direction, each of said faces being substantially flush with said cup-shaped portion and projecting radially inward beyond said rim portion.

6. A machine as set forth in claim 5, wherein said peripheral portion, in each of said recesses, has a surface parallel to said axis and substantially flush with said rim portion.

7. A machine as set forth in claim 4, wherein said receptacle is fixedly connected to said plate member.

8. A machine as set forth in claim 4, wherein said cup-shaped portion has an apertured wall extending radially relative to said axis, an outer, annular, axial wall connecting said radial wall to said peripheral portion, and an inner, annular, axial wall projecting from said radial wall toward said receptacle, and bounding an axial feed channel, said feeding means including means for feeding said slurry to said receptacle through said channel.

9. A machine as set forth in claim 1, wherein said bowl has a circumferential wall flaring conically in said one direction, and has a narrow end fixedly fastened to said hub portion and a wide end, and overflow means at said wide end for discharging a portion of said slurry.

* * * * *